US006597103B1

(12) United States Patent
Meissner et al.

(10) Patent No.: US 6,597,103 B1
(45) Date of Patent: Jul. 22, 2003

(54) DISPLAY TUBE

(75) Inventors: Joerg Meissner, Eindhoven (NL); Ben Heinz Hageluken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 219 days.

(21) Appl. No.: 09/716,909

(22) Filed: Nov. 20, 2000

(30) Foreign Application Priority Data

Dec. 22, 1999 (EP) ..... 99204471

(51) Int. Cl.[7] ..... H01J 29/92; H01J 29/46; H01J 31/00

(52) U.S. Cl. ..... 313/481; 313/558; 313/477 R; 313/479; 445/58

(58) Field of Search ..... 313/481, 479, 313/477 R, 558, 553, 291, 477 HC, 561; 445/55, 58

(56) References Cited

U.S. PATENT DOCUMENTS 4,622,490 A * 11/1986 Benway ..... 313/402
4,977,348 A * 12/1990 Odenthal ..... 313/479
5,087,855 A 2/1992 Overbeek et al. ..... 313/477
5,350,970 A * 9/1994 Vennix et al. ..... 313/481
5,561,341 A * 10/1996 Won ..... 313/406

FOREIGN PATENT DOCUMENTS

DE 19542263 A 6/1996 ..... H01J/29/06

* cited by examiner

*Primary Examiner*—Robert H. Kim
*Assistant Examiner*—Elizabeth Gemmell
(74) *Attorney, Agent, or Firm*—Aaron Waxler

(57) ABSTRACT

The invention relates to a display tube comprising an envelope portion 2 having an inner surface provided with a first electrically conductive layer 7 and a faceplate 1 having an inner surface provided with a second electrically conductive layer 8, which faceplate 1 is secured to the envelope portion 2 at a sealing edge 15, and further comprising a contacting layer 33 which is deposited in an area partially overlapping the first electrically conductive layer 7 and the second electrically conductive layer 8 in order to electrically connect said first electrically conductive layer 7 to said second electrically conductive layer 8.

11 Claims, 6 Drawing Sheets

DISPLAY TUBE

BACKGROUND OF THE INVENTION

The invention relates to a display tube comprising an envelope portion having an inner surface provided with a first electrically conductive layer and a faceplate having an inner surface provided with a second electrically conductive layer, which faceplate is secured to the envelope portion, and further comprising connection means to electrically connect said first electrically conductive layer to second electrically conductive layer.

A display tube of the type mentioned in the opening paragraph is disclosed in U.S. Pat. No. 5,087,855 (PHN 13.021), which discloses a cathode ray tube having an envelope portion with a high-voltage contact extending through the wall of said envelope portion, and a faceplate which is sealed to the envelope portion. The envelope is internally coated with a first electrically conductive layer and the faceplate is coated with a second electrically conductive layer. The high-voltage contact consists of an anode button being projected inwardly. A connection means having two tongue-shaped members is fastened to the anode button at the inner side of the envelope portion. The tongue-shaped members extend on both sides of the high-voltage contact and engage the respective first and second electrically conductive layers.

A display tube of the type defined in the opening paragraph is generally used for displaying monochrome pictures, color pictures or for displaying figures or letters (Data Graphic Displays). In practice, it was, however, found that in some cases the display of a picture is not always produced in the desired manner so that detrimental effects may occur. Particularly, when the display tube is subjected to vibrations and/or high accelerations, the display of a picture may be disturbed.

SUMMARY OF THE INVENTION

It is inter alia an object of the invention to provide a display tube in which the occurrence of said detrimental effects is prevented at least in a number of cases.

According to the invention, a display tube of the type defined in the opening paragraph is therefore characterized in that said connection means comprise a contacting layer which is provided in an area partially overlapping the first electrically conductive layer and the second electrically conductive layer.

The invention is based on the recognition that the detrimental effects occur at least partially because the first electrically conductive layer and the second electrically conductive layer are not electrically connected to a sufficient extent, and the supply of a voltage to the layers is not adequate in some cases. Particularly the use of mechanical means, such as the tongue-shaped members in U.S. Pat. No. 5,087,855, in order to electrically connect the first and the second electrically conductive layer may yield contact disruptions when the display tube is subjected to vibrations and/or high accelerations.

An insufficient electric connection between the first and the second conductive layer may yield unwanted electromagnetic fields. On their path to the display screen electron beams generated by an electron-generating system provided in the envelope portion can detrimentally be influenced by these electromagnetic fields. This causes an uncontrollable and unwanted shift of the electron beams which results in a distortion of a picture to be displayed.

The display tube of the invention has been found to ensure an adequate electric connection between the first electrically conductive layer and the second electrically conductive layer because of the very stable connection provided by the contacting layer. This electric contact ensures a good operation of the display tube even without additional mechanical connection means. Even when the only connection means is the contacting layer, which is deposited in an area partially overlapping the first electrically conductive layer and the second electrically conductive layer, than good operation of the display tube can thus be ensured.

When the first or the second electrically conductive layer has a high resistivity, the overlap of the contacting layer with said layer having a high resistivity is preferably such that the area of overlap is at least 1 $cm^2$. Because of the high resistivity, which in most cases is several kilo Ohms, a too small overlap area would result in local heating of the layers which is unfavourable for the lifetime of the contacting layer and thus for the lifetime of the display tube.

When the first or the second electrically conductive layer has a high conductivity, the overlap of the contacting layer with said layer having a high conductivity is less critical. As the contacting layer usually also has a high conductivity, a small overlap area is sufficient to establish an electric contact according to the invention.

Preferably, the contacting layer has a thickness of more than 10 nm. A very thin layer may result in an unreliable electric contact or in heating of said layer, which heating is unfavourable for the lifetime of the contacting layer and thus for the lifetime of the display tube. On the other hand, a too thick contacting layer may scale off, yielding loose particles in the display tube, which should be avoided.

The contacting layer according to the invention adheres to the underlying material. It has been found that the use of mechanical means that press against the first and the second electrically conductive layer, as commonly used, may introduce loose particles in the display tube due to scratching of the internal layers by the mechanical contact. This problem is also reduced in the display tube of the invention.

The electrical resistance of the electric interconnection of the first and the second electrically conductive layer by the contacting layer is preferably less than 100 Ω. Typically, when using a material with a high conductivity such as Ba having a layer thickness of approximately 100 nm, the electrical resistance of the electric interconnection of the first and the second electrically conductive layers by the contacting layer is approximately 1Ω.

A way to establish the electric connection according to the invention is provided by the following method of electrically connecting a first electrically conductive layer is provided on the inner side of an envelope portion of a display tube and a second electrically conductive layer provided on the inner side of a faceplate of the display tube, which faceplate is secured to the envelope portion at a sealing edge, by depositing a contacting layer of a conductive material at the inner side of the display tube, which conductive material is deposited in an area bridging the sealing edge and electrically contacting the first electrically conductive layer and the second electrically conductive layer.

Preferably said contacting layer does not only have a good adhesion to the first and the second electrically conductive layer, but also to the material in between, which material may comprise glass and frit material. Said frit material is used to seal the envelope portion to the faceplate. The frit material is a semi-crystalline glass comprising PbO, ZnO and $SiO_2$. The semi-crystalline glass comprises at least one crystalline phase in a matrix of a glass phase.

Although the contacting layer may be deposited by simply painting an electrically conductive paint or printing an electrically conductive layer, it is preferred that the contacting layer is provided by vacuum deposition. Vacuum deposition may also comprise sputtering. Using vacuum deposition, an electrically conductive layer can be deposited after the display tube has been evacuated. When the vacuum pumping of the display tube has been completed, the electrically conductive material is evaporated to produce a cloud that moves towards the sealing edge, and a thin layer of electrically conductive material is deposited at least in an area bridging the sealing edge and electrically contacting the first electrically conductive layer and the second electrically conductive layer.

Preferably, the contacting layer is not deposited on the screen section of the faceplate. A deposition on the screen should be avoided because this may have an unfavourable influence on the brightness of the display.

The electrically conductive material forming the contacting layer preferably comprises an electrically conductive getter material and/or a metal. The getter material may comprise a material chosen from the group comprising Ba, Ti, Zr, or mixtures of these materials. In order to bind residual gases in the evacuated display tube, a getter material (in the form of a pill) such as Ba or Ti, may be evaporated to produce a fine spread of getter material, called the 'getter mirror'. In colour display tubes, metallic Ba is commonly used as a getter. A Ba getter mirror is electrically conductive and may be used for bridging the sealing edge and electrically contacting the first electrically conductive layer and the second electrically conductive layer.

Although the use of a Ba getter mirror for binding residual gases is well known, this getter mirror is not deposited at the sealing edge, because the deposition at the sealing edge is blocked by an Internal Magnetic Shield (IMS), as shown in DE 19542263 for example. The IMS is made of a ferromagnetic material and is intended to substantially shield the electron beam from the earth's magnetic field.

An embodiment of the method according to the invention requires an area adjacent to a position on the sealing edge, including at least a small area of the first and the second electrically conductive layer, to be covered with getter material which is evaporated when the getter pill is heated.

A preferred embodiment of the display tube according to the invention is a display tube comprising an internal magnetic shield having at least one opening, wherein the opening in the internal magnetic shield is located so as to allow deposition of the contacting layer on the sealing edge. Preferably, said display tube further comprises a getter pill, wherein the opening in the internal magnetic shield is located with respect to the position of the getter pill so as to allow deposition of the contacting layer comprising getter material, which getter material originates from the getter pill. This may be achieved, for example, by making cut-outs in the IMS. When said area adjacent to a position on the'sealing edge is visible from the position of the getter pill, the evaporated Ba covers this area with a Ba getter mirror. This metallic mirror then provides a conductive electric contact between the first and the second electrically conductive layer.

Another preferred embodiment of the display tube according to the invention is a display tube comprising a deflector positioned on the getter pill receptacle, wherein the deflector is positioned so as to allow deposition of the contacting layer comprising getter material, which getter material originates from a getter pill. As an alternative to the opening in the IMS, a deflector may be positioned on the getter pill receptacle, which deflector directs a part of the evaporated getter material towards the sealing edge. Due to the deflection of the evaporated getter material, a contacting layer is deposited, which contacting layer provides an electric contact between the first electrically conductive layer and the second electrically conductive layer.

BRIEF DESCRIPTION OF THE DRAWINGS

These and other aspects of the invention are apparent from and will be elucidated with reference to the embodiments described hereinafter

The Figures are not drawn to scale. In general, like reference numerals refer to like parts.

DETAIL DESCRIPTION

Figure 1:
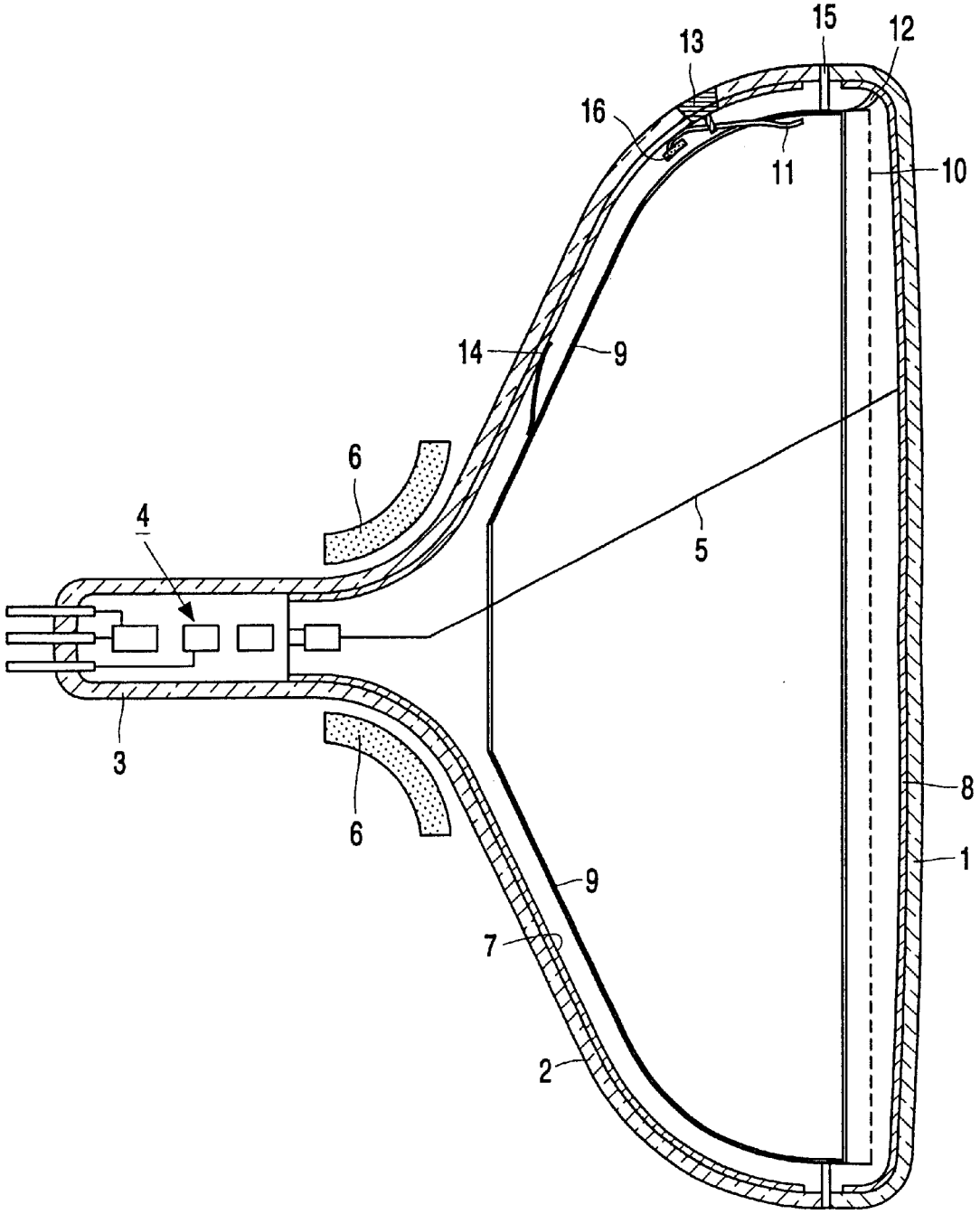
FIG. 1 Prior Art
FIG. 1 is a schematic cross-sectional view of a display tube.

The display tube shown in FIG. 1 in a longitudinal cross-sectional view has a glass envelope comprising a faceplate 1, a cone-shaped envelope portion 2 and a neck portion 3. The faceplate 1 is secured to the cone-shaped envelope portion 2 at a sealing edge 15. The neck portion 3 includes an electron-generating system 4 for generating an electron beam 5 which is directed to a display screen (not shown) provided on the inner side of the faceplate 1. On its path to the display screen, the electron beam 5 is deflected across the display screen with the aid of a plurality of deflection coils 6 which are coaxially positioned around the tube axis. The inner wall of the envelope portion 2 is provided with a first electrically conductive layer 7 and the inner wall of the display window 1 is provided with a second electrically conductive layer 8. The first electrically conductive layer 7, also called the soft-flash layer, can be made of a resistance material composed of, for example, a mixture of ferrioxide, graphite and potassium silicate. The second electrically conductive layer 8 is, for example, a thin aluminum layer.

Figure 2A:
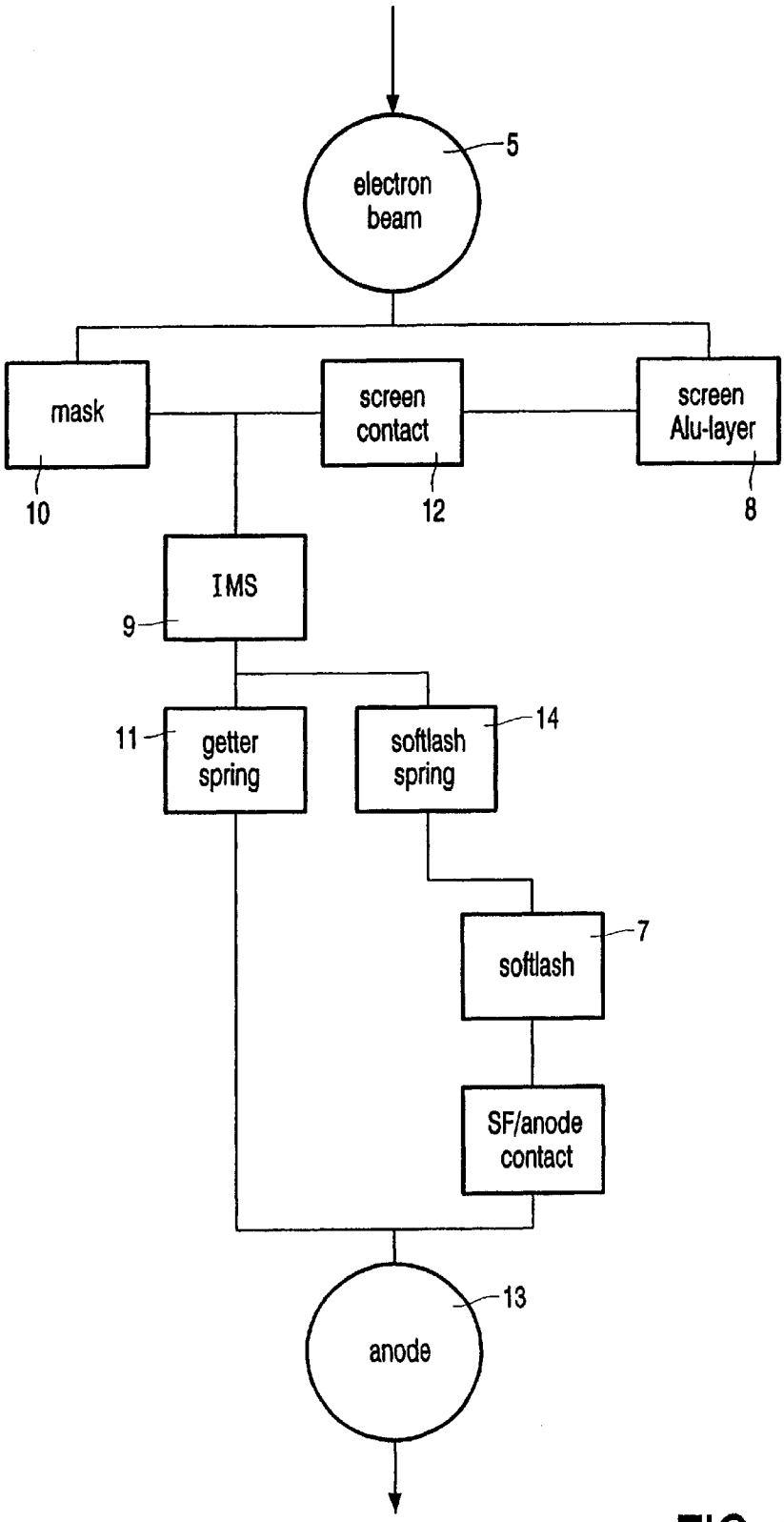
FIG. 2A Prior Art
FIG. 2A is a schematic diagram of the electric network of internal contacts in a display tube.

Inside the envelope, an IMS 9 is provided, which is attached to a mask-frame 10. The IMS is electrically connected to the first electrically conductive layer 7 and the anode 13 via the getter spring 11. The getter spring 11 also holds the getter pill 16. The IMS 9 is also electrically connected to the second electrically conductive layer 8 via the screen contact 12. In this way, the second electrically conductive layer 8, the IMS 9 and mask (via the mask-frame 10) are connected to the anode 13. An additional electric contact between the first electrically conductive layer 7 and the IMS 9 may be provided by a so-called soft-flash spring 14. The soft-flash spring 14 works within an electric network of internal contacts between the anode 13, the metal parts (IMS 9 and mask-frame 10), the first electrically conductive layer 7 and the second electrically conductive layer 8 of the display screen. The function of this network, which is depicted in FIG. 2A, can be defined as:

providing an electrical continuity between the display screen, the metal parts (9 and 10) and the anode 13, and providing means for charging and discharging the tube capacitance. In practice, both the getter spring 11 and the soft-flash spring 14 are present to provide the electrical continuity of the tube under most conditions. However, the use of mechanical means, such as the contact springs 11 and 14, for electrically connecting the first and the second electrically conductive layer may yield contact disruptions when the display tube is subjected to vibrations and/or high accelerations. When the electrical continuity is not provided, the display tube does not work properly. The typical picture effect of display tubes with a breached electrical continuity is an unstable flickering pattern with missing lines in the white picture. This effect was expected to occur in all display tubes without soft-flash spring 14 and missing getter contact spring 11. Surprisingly, some display tubes operated perfectly. A close examination on these working display tubes revealed that cut-outs in the IMS 9 of these display tubes allowed the deposition of a getter mirror which bridged the, sealing edge and provided the electrical continuity.

Figure 2B:
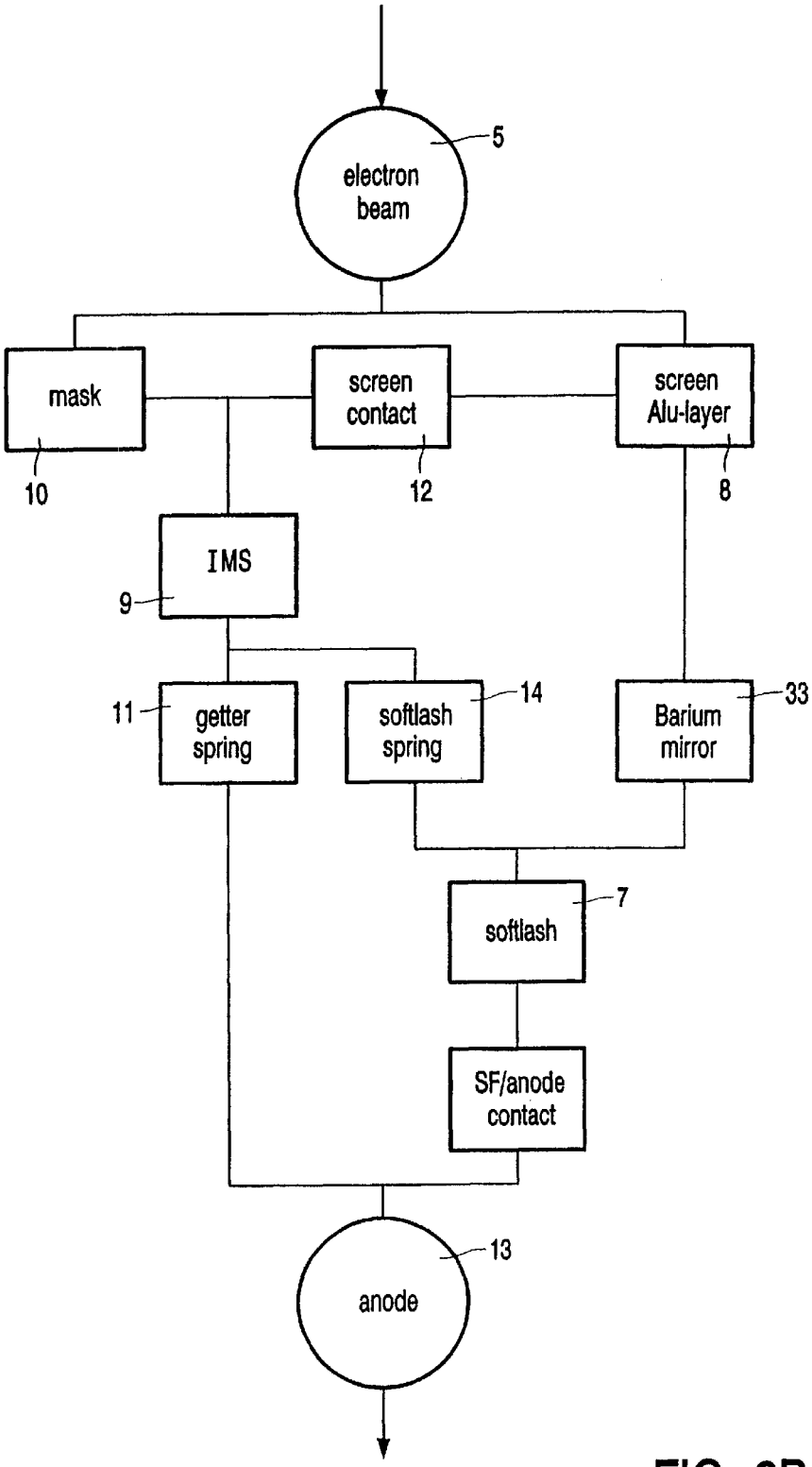
FIG. 2B Prior Art
FIG. 2B is a schematic diagram of the electric network of internal contacts in a display tube with a contacting layer according to the invention.
Figure 2C:
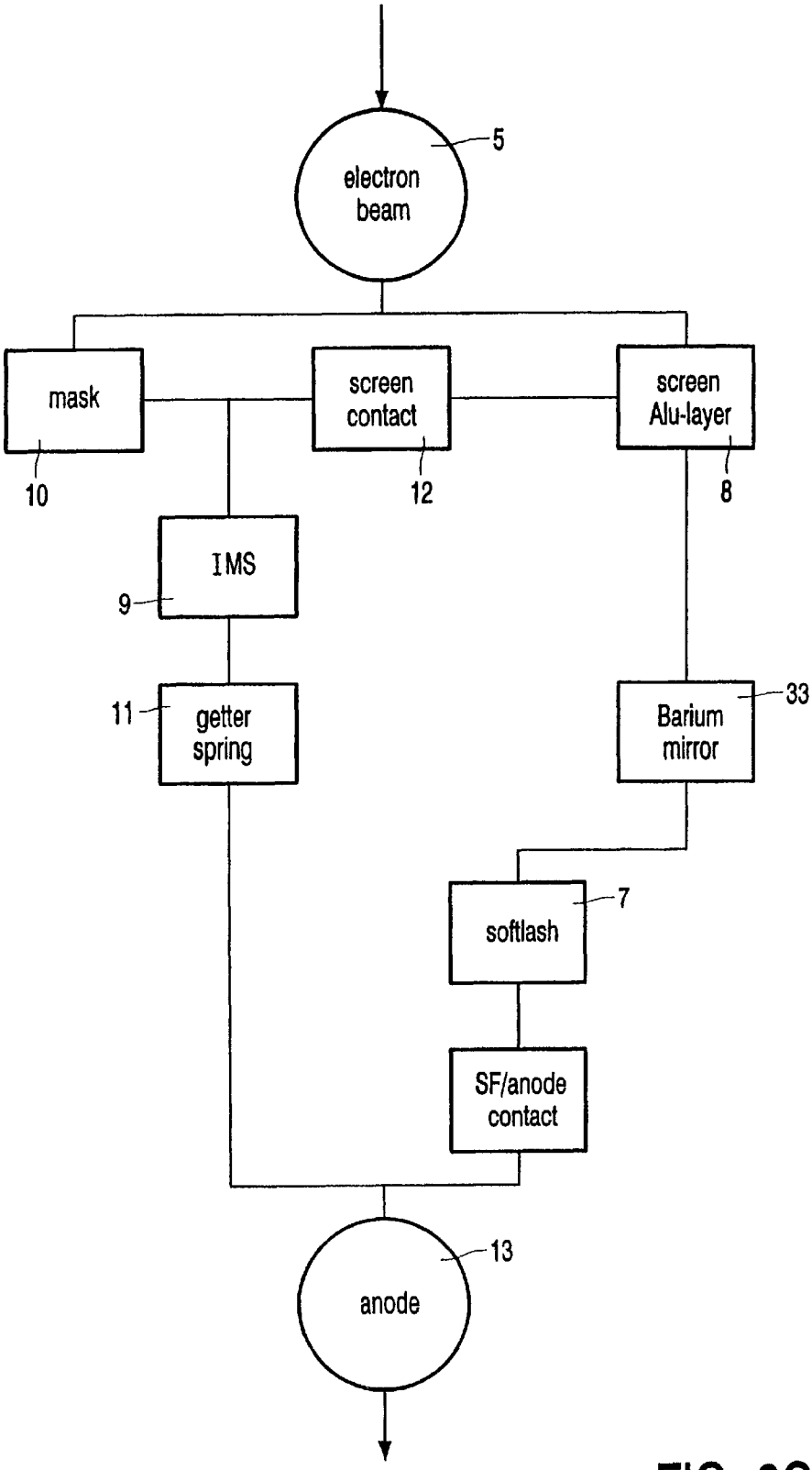
FIG. 2C Prior Art
FIG. 2C is a schematic diagram of the electric network of internal contacts in a display tube with a contacting layer according to the invention, and without the soft-flash spring.

The display tube according to the invention comprises a getter mirror which is deposited in an area bridging the sealing edge 15 and electrically contacting the first electrically conductive layer 7 and the second electrically conductive layer 8 (see FIG. 2B). This electric contact ensures a good operation of the display tube, even without getter spring 11 and soft-flash spring 14 contact. The getter mirror on the sealing edge, contacting the first and the second electrically conductive layer (7 and 8, respectively), provides a heavy-duty contact and is an inexpensive and reliable alternative to the spring contacts. Particularly the soft-flash spring 14 may be omitted (see FIG. 2C).

Figure 3:
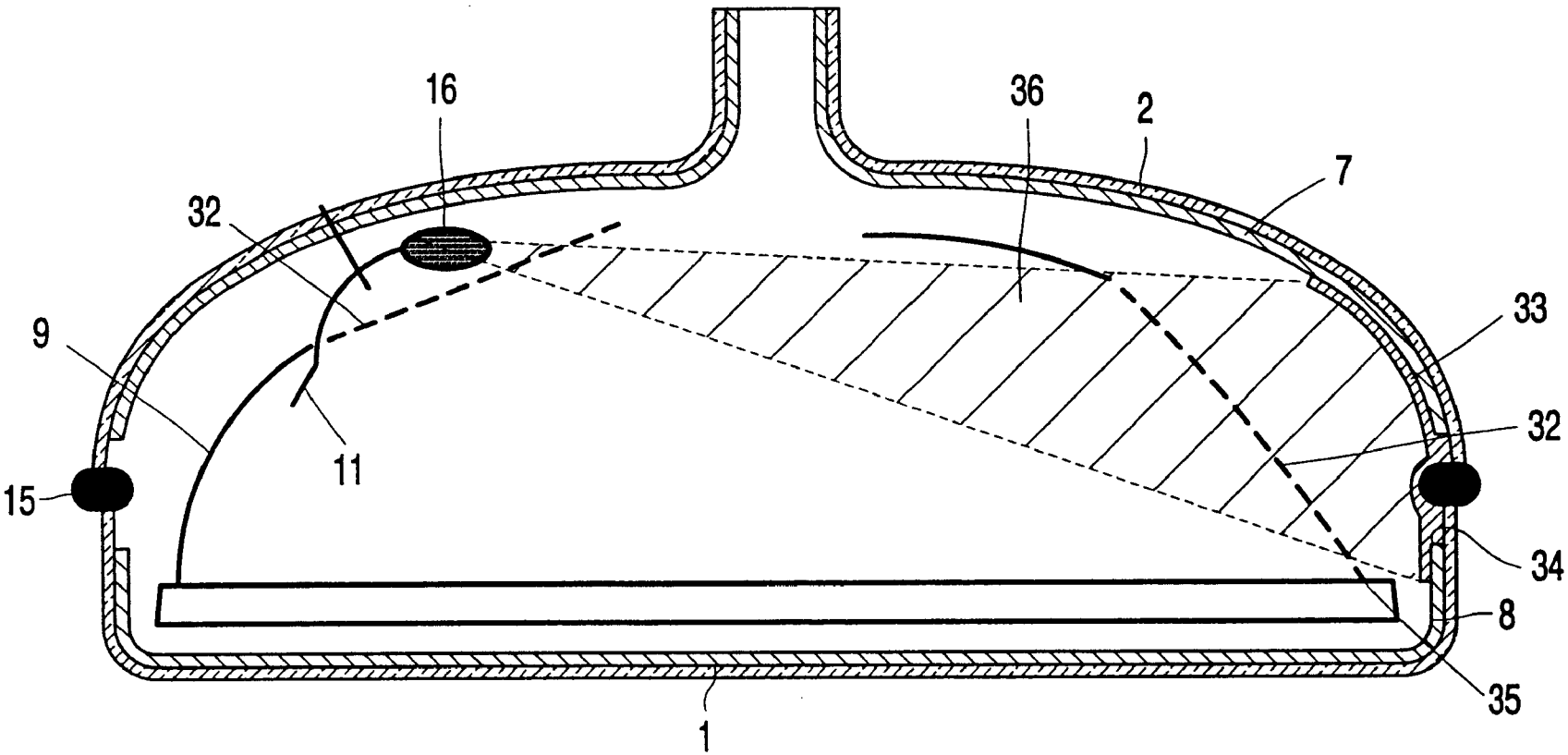
FIGS. 3 and 4 show some embodiments of the connection means provided in the display tube according to the invention.

As depicted in FIG. 3, during the getter evaporation, the getter material is evaporated from the getter pill 16 into a sphere around the pill, and condenses on the surfaces opposite the pill. If an area around the sealing edge 15, including at least the border area of the first electrically conductive layer 7 and the second electrically conductive layer 8, is visible from the position of the getter pill, due to any cut-outs 32 in the IMS, for example, the evaporated getter material covers this area too where it generates a getter mirror 33. The getter evaporation sector of interest for the invention is indicated by reference numeral 36 in FIG. 3. The getter mirror 33 provides an electric contact between the first electrically conductive layer 7 and the second electrically conductive layer 8.

It can be controlled whether there is enough overlap between the getter mirror 33 and the first electrically conductive layer by adjusting the height of the IMS cut-out 32 (see FIG. 3). However, the most critical geometry parameter is the overlap between the getter mirror 33 and the second electrically conductive layer 8 on the faceplate 1. The latter overlap depends on the relative position between the getter pill 16, the cut-out 32 in the IMS and the distance between the aluminum borderline 34 and the sealing edge 15. In the direction towards the border line 34 of the second electrically conductive layer 8, the cut-out 32 of the IMS 9 is limited by the skirt of the IMS 35 (see FIG. 3).

Figure 4:
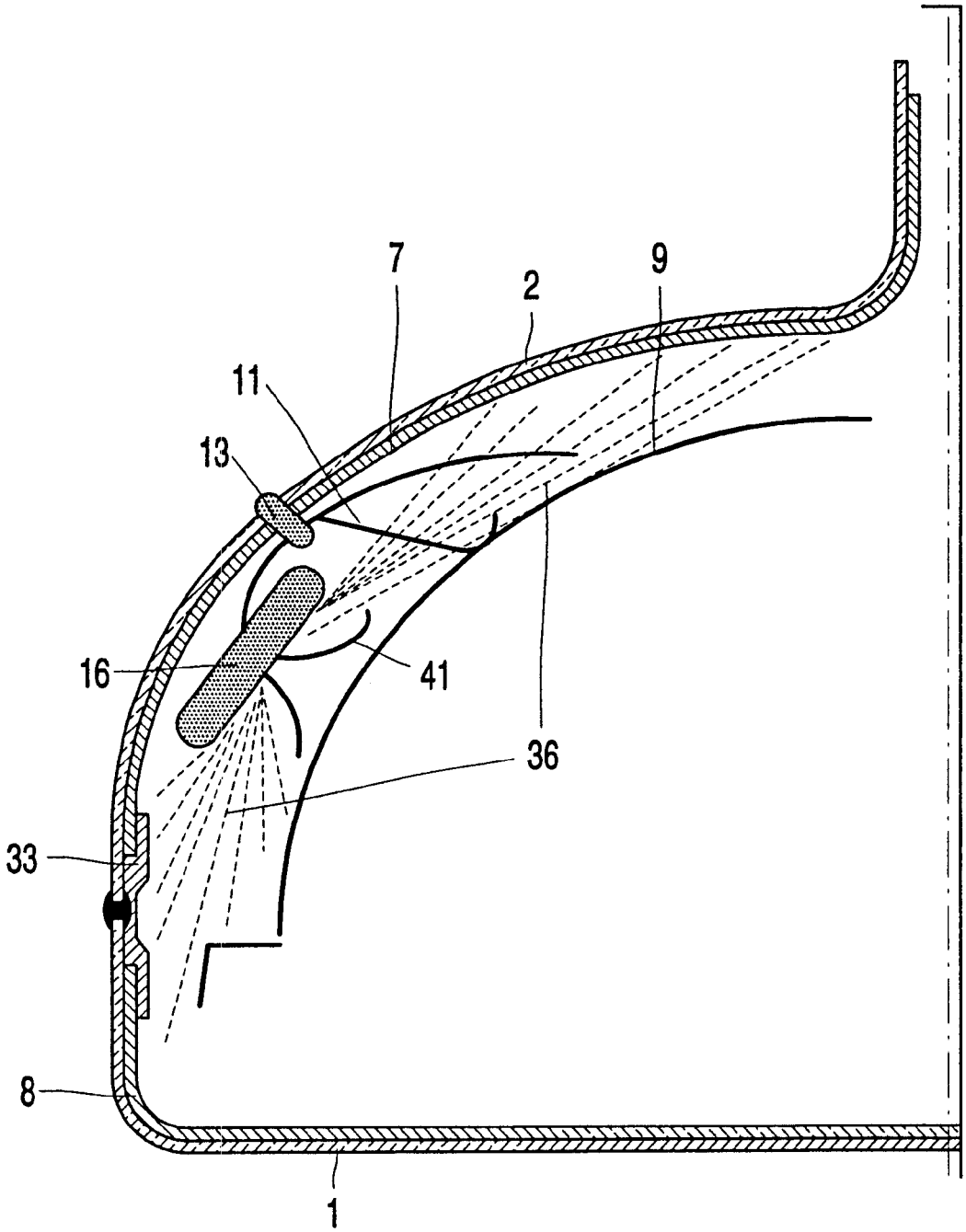

A way to avoid cut-outs 32 in the IMS 9 that allow deposition of the contacting layer according to the invention is to use deflectors 41 on the getter pill 16 receptacle as depicted in FIG. 4. Here, the IMS 9 may have cut-outs providing improved magnetic shielding properties, but these cut-outs are not at a position to allow deposition of the contacting layer according to the invention. The evaporated getter 36 is directed by the deflectors 41 and generates a getter mirror on the sealing edge 33, which getter mirror 33 provides a heavy-duty electrical continuity of the display tube.

After opening the tube, the getter will react with air. When Ba is used as a getter material, the Ba is converted into $BaCO_3$ and $Ba(OH)_2$ and the electric connection between the first electrically conductive layer 7 and the second electrically conductive layer 8 is destroyed. Only a shadow of the Ba-mirror is still visible on the first electrically conductive layer 7 and the second electrically conductive layer 8, indicating the presence of a contacting layer in the original display tube.

In summary, the invention relates to a display tube comprising an envelope portion 2 having an inner surface provided with a first electrically conductive layer 7 and a faceplate 1 having an inner surface provided with a second electrically conductive layer 8, which faceplate 1 is secured to the envelope portion 2 at a sealing edge 15, and further comprising a contacting layer 33 which is deposited in an area partially overlapping the first electrically conductive layer 7 and the second electrically conductive layer 8 in order to electrically connect said first electrically conductive layer 7 to said second electrically conductive layer 8.

It will be clear that within the framework of the invention many variations are possible. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the pregence of other elements or steps than those listed in the claim.

What is claimed is:

1. A display tube comprising an envelope portion (2) having an inner surface provided with a first electrically conductive layer (7) and a faceplate (1) having an inner surface provided with a second electrically conductive layer (8), which faceplate (1) is secured to the envelope portion (2), and further comprising connection means to electrically connect said first electrically conductive layer (7) to said second electrically conductive layer (8), characterized in that said connection means comprise a contacting layer (33) which is provided in an area partially overlapping the first electrically conductive layer (7) and the second electrically conductive layer (8).

2. A display tube as claimed in claim 1, wherein the contacting layer (33) is the only connection means between the first electrically conductive layer (7) and the second electrically conductive layer (8).

3. A display tube as claimed in claim 1, further comprising an internal magnetic shield (9) having at least one opening, wherein the opening in the internal magnetic shield (9) is located so as to allow deposition of the contacting layer (33) on the sealing edge (15).

4. A display tube as claimed in claim 3, further comprising a getter pill (16), wherein the opening in the internal magnetic shield (9) is located with respect to the position of the getter pill (16) so as to allow deposition of the contacting layer (33) comprising getter material, which getter material originates from the getter pill (16).

5. A display tube as claimed in claim 1, further comprising a deflector (41) positioned on the getter pill (16) receptacle, wherein the deflector is positioned so as to allow deposition of the contacting layer (33) comprising getter material, which getter material originates from the getter pill (16).

6. A display tube as claimed in claim 1, wherein the contacting layer (33) comprises a material chosen from the group comprising conductive getter materials and/or metals.

7. A display tube as claimed in claim 6, wherein the contacting layer (33) comprises a material chosen from the group comprising Ba, Ti, Zr, or mixtures of these materials.

8. A method of electrically connecting a first electrically conductive layer (7) provided on the inner side of an envelope portion (2) of a display tube and a second electrically conductive layer (8) provided on the inner side of a faceplate (1) of the display tube, which faceplate (1) is secured to the envelope portion (2) at a sealing edge (15), by depositing a contacting layer (33) of a conductive material on the inner side of the display tube, which conductive material is deposited in an area bridging the sealing edge (15) and electrically contacting the first electrically conductive layer (7) and the second electrically conductive layer (8).

9. A method as claimed in claim 8, wherein the contacting layer (33) is provided by vacuum deposition.

10. A method as claimed in claim 8, wherein the contacting layer (33) is formed by depositing a material chosen from the group comprising conductive getter materials and/or metals.

11. A method as claimed in claim 10, wherein the contacting layer (33) is formed by depositing a material chosen from the group comprising Ba, Ti, Zr, or mixtures of these materials.

* * * * *